US005207433A

United States Patent [19]

Moore

[11] Patent Number: 5,207,433

[45] Date of Patent: May 4, 1993

[54] FOOTBALL GAME, APPARATUS AND METHOD OF PLAY

[76] Inventor: Robert A. Moore, 3605 Briardale Dr., NW., Massillon, Ohio 44646

[21] Appl. No.: 782,125

[22] Filed: Oct. 25, 1991

[51] Int. Cl.[5] ..... A63B 67/00

[52] U.S. Cl. ..... 273/411; 273/55 R; 273/400

[58] Field of Search ..... 273/411, 55 R, 55 B, 273/55 D, 398, 400, 341

[56] References Cited

U.S. PATENT DOCUMENTS

| | | | |
|---|---|---|---|
| 1,392,662 | 10/1921 | Seibold | 273/400 |
| 1,419,554 | 6/1922 | Ganse | 273/411 |
| 1,433,437 | 10/1922 | Wakeham | 273/411 |
| 1,933,159 | 10/1933 | Butler | 273/411 |
| 1,935,370 | 11/1933 | Nekuda | 273/341 |
| 2,576,321 | 11/1951 | Volz | 273/55 R |
| 3,227,449 | 1/1966 | Schwab | 273/55 R |
| 3,820,787 | 6/1974 | Heinbigner | 273/55 B |
| 3,822,883 | 7/1974 | De Vos | 273/411 X |
| 3,823,939 | 7/1974 | Bottorff | 273/55 R |
| 3,841,634 | 10/1974 | Mavrofrides | 273/411 |
| 3,865,371 | 2/1975 | Theriot | 273/411 |
| 4,029,315 | 6/1977 | Bon | 273/55 R |
| 4,211,413 | 7/1980 | Arzola | 273/411 |
| 4,355,813 | 10/1982 | Rathjen | 273/411 |
| 4,482,157 | 11/1984 | McNeil | 273/411 |
| 4,687,208 | 8/1987 | Thomas | 273/411 |
| 4,758,002 | 7/1988 | Murphy | 273/411 |
| 4,781,385 | 11/1988 | Harley | 273/411 |
| 4,798,389 | 1/1989 | Long | 273/411 |
| 4,826,166 | 5/1989 | Baker et al. | 273/55 R |
| 4,911,443 | 3/1990 | Foster | 273/55 D |
| 5,037,095 | 8/1991 | Nedwick | 273/55 R |

*Primary Examiner*—William H. Grieb
*Attorney, Agent, or Firm*—Michael Sand Co.

[57] ABSTRACT

The present invention relates to a variation of the traditional American football game concentrating on the passing aspects which demands virtually all of the athletic skills of traditional football, but capable of being played by a minimal number of players, preferably varying from three to five players. The subject game including new apparatus and method of playing employs a number of the refinements of the professional football passing game, based upon its timing and spacing aspects to provide a real athletic challenge, which game may be played on a smaller field, on both inside and outside facilities, the playing field consisting of a level open space at least 40 yards long and 30 yards wide. Spaced-apart markers are used to designate the offensive receiver positions for thrown passes and varied defensive alignments to prevent successful passing into a plurality of stationary nets or baskets.

35 Claims, 4 Drawing Sheets

RUN -N- SHOOT
1-1-2 DEFENSE

RUN -N- SHOOT
1-1-2 DEFENSE

RUN -N- SHOOT
1-3 DEFENSE

RUN -N- SHOOT
2-2 DEFENSE

FOOTBALL GAME, APPARATUS AND METHOD OF PLAY

BACKGROUND OF THE INVENTION

Technical Field

This invention relates to an apparatus and method for playing a game and, more particularly, to a new non-contact football game primarily employing the passing aspects of traditional American football.

Background Information

The well-known game of American football has remained essentially unchanged over the past century, except for minor changes in the rules and player equipment. The varied aspects of the game as played by high schools, colleges and professionals have evolved into an essentially uniform set of rules and player equipment. For new and former players, both young and older, the tackling aspects and protective equipment have required more sophisticated running and blocking aspects of the game, while the passing aspects have developed into probably the most spectacular part of the game. The present invention is intended to utilize as its primary purpose, the more standardized advanced forms of offensive passing and defensive positioning to thwart successful passing. While the traditional American game requires greater numbers of players than the subject game i.e. eleven players on each side, the present game may be played by a fewer number of players of varying ages, one player serving as the offensive quarterback and the remaining players serving as defensive players to be opponents of the offense.

The present game may be played by three to five players of widely varying ages such as those too young for organized teams and older players, or a mixture of both, in a game which simulates a professional passing offense and defensive schemes to prevent successful passing. The quarterback player may be downed by touching, by tackling or by a flag, depending upon the downing technique option. Spaced-apart net or basket members are positioned in some of the traditional passing patterns to serve as receivers for the quarterback's passing, while the defensive players are stationed at spaced-apart intervals from the nets or baskets to prevent advancing the ball by successful passing attempts into the nets or baskets.

SUMMARY OF THE INVENTION

A primary object of the invention is to provide a variation of traditional American football concentrating on the passing aspects which demands virtually all of the athletic skills of traditional football, but capable of being played by a minimal number of players, preferably varying from three to five players.

Another object of the invention is to provide a method of playing a football passing game which employs a number of the refinements of the professional football passing game based upon its timing and spacing aspects to provide a real athletic challenge, which game may be played on a smaller field, on both inside and outside facilities, the playing field consisting of a level open space at least about 40 yards long and about 30 yards wide.

Another object of the invention is to provide a new game including all aspects of the football passing game which requires enhanced athletic skills but which may still be competitive for both young and older players, especially those who are most familiar with the football passing game as played by professional football teams.

Another object of the invention is to provide a method for playing a football passing game by a lesser number of players than traditional football which utilizes the most challenging aspects of the passing game and its fast-paced action, while mitigating the severe physical contact of the traditional American game.

The subject game utilizes a number of the major timing aspects of the professional game while nets or baskets serve as the pass receivers. The defensive players must assume spaced positions from the nets in their initial positioning and the quarterback tries to overcome the defensive alignment and/or coverage of the nets by successfully passing into one of the nets. The field utilizes a limited area preferably at least 40 yards long and about 30 yards wide which facilitate playing the game on smaller lots or residential yards of limited dimensions.

One player serves as the single offensive player, i.e. the quarterback, who attempts to advance the football downfield toward the goal line in the same manner as in traditional football. The quarterback has 3 offensive plays to gain 10 yards in order to retain possession of the ball. When he retains possession and advances the ball to within the 30 yard line, he is given 4 offensive plays to score a touchdown generally similar to the traditional game. He is given 1 play to score an extra point, and scoring is similar, 6 points for a touchdown and 1 point for an extra point. The passing skills of the quarterback player are a major challenge and such skills are more fully developed in playing the subject game with fewer opportunities for injury.

The remainder of the players serve as defensive players and must be positioned at spaced-apart initial positions from the ball-receiving nets or baskets upon initiation of a given play. The quarterback position is rotated among all the players in an agreed-upon rotation in the event of a score or failure to advance by ball by the quarterback offensive player. The defending skills of the defensive players are also a major challenge and such skills are more fully developed in playing the subject game with fewer injuries. The game is extremely useful in developing and improving the skills of young football players for subsequent playing of the traditional game.

The nets are positioned at five, ten and twenty yard intervals from the line of scrimmage at the initial option of the quarterback, the net positions being marked on the playing field or by individual flexible plastic mats indicating the ball receiving positions, i.e. preferably seven in number. The defensive player initial positions are also similarly marked on the field or by flexible plastic mats, spaced away from the nets, the spacing being greater for the defenders away from the nets the further the nets are located from the line of scrimmage. The spacings are dictated by the average timing aspects of pass completions in the traditional game as played by professionals. Further, the locations of the nets are typical of the most common passing formations of the traditional game, i.e. receivers coming out of the backfield, and so-called post patterns, and fly patterns at the intermediate and greatest distances from the line of scrimmage.

BRIEF DESCRIPTION OF THE DRAWINGS

Preferred embodiments of the invention, illustrative of the best modes in which applicant has contemplated applying the principles, are set forth in the following description and are shown in the drawings, and are particularly and distinctly pointed out and set forth in the appended claims.

Similar numerals refer to similar parts throughout the drawings.

DESCRIPTION OF THE PREFERRED EMBODIMENT

Figure 1:
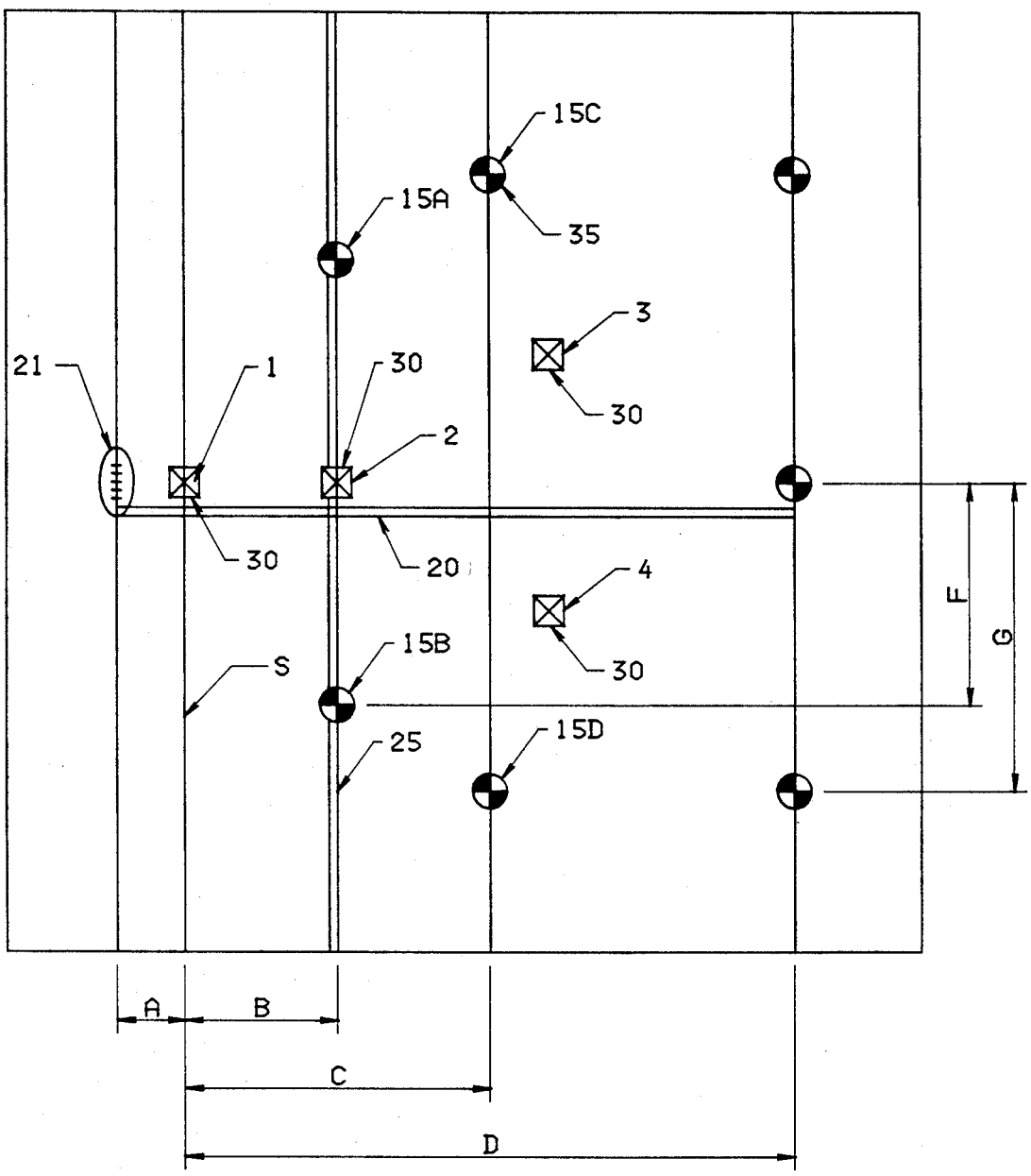
FIG. 1 is a plan view of the marked playing field showing the net positions as circles and the defensive player positions as Xs, the defensive positions marked for a typical 1-1-2 defensive alignment, the preferred dimensions of the respective positions also being shown.

The subject new game primarily utilizes the passing aspects of the traditional football game, particularly those aspects which have been generally defined as "run and shoot" offenses which feature precise timing of passing plays. The game is played on a playing field measuring about 40 yards long and about 30 yards wide, although the dimensions may be larger, or smaller, or modified if desired. The game is designed for three, four or five players with baskets or nets located in fixed positions which serve as ball receivers and which the defensive players attempt to guard to prevent the football from being passed into one of the nets.

Initially, the selected quarterback player has the option of positioning the stationary nets once for each possession and must set at least one net at each distance of five, ten and twenty yards when four or five players are involved in the game. The same number of nets is used as there are defenders and, as stated, the quarterback positions the nets at his discretion when he initially becomes the quarterback player.

Prior to commencing the game, a first lengthy flexible plastic tape 20 is used to mark off prescribed distances on the center line of the field. The tape serves to place a series of individual markers on the field at prescribed distances for both offensive and defensive players. The first lengthy tape 20 has a preferred length of 22 yards and markings for the line of scrimmage with a 2 yard marking "A", FIG. 1 for the quarterback initial position 21 in one direction for the offensive starting position of the quarterback. The first tape has markings at 5, 10 and 20 yard intervals from the line of scrimmage indicated at B, C and D, respectively, (FIG. 1) in the other direction for alignment of both ball receiving nets and defensive players. The first tape 20 has markings such as designations of X or 1 at the line of scrimmages and at 5 and 12 yard locations for marking defensive player positions 2 and 7 on the field center line in the 1-1-2 and 1-3 defenses. Flexible plastic squares or plastic mats 30 in the form of squares marked with Xs and a color coding are shown on the first tape for two defensive alignments where defensive players 1 and 2 are positioned in the middle of the field.

A second cross-member flexible tape 25 is then positioned transversely to the first tape initially at the 5 yard lengthwise position B to indicate both one defensive player position 2 in the center of the field, and two equally spaced apart net positions 15A and 15B from the center line, these positions being shown on the second tape about 7 yards or distance P from the center line. Such second tape has a length of about 20 yards to indicate both offensive and defensive player alignments. The second tape is then placed transversely of the first tape at a 10 yard interval indicated at C (FIG. 2) to mark net or receiver positions 15C and 15D at about 10 yards indicated at 6, from the center line on opposite sides thereof. The use of the first and second flexible tape members expedites the start of the game by properly marking the field with the preferred spacings to reproduce the timing aspects of the traditional passing game and the most common pass receiving patterns.

Figure 2:
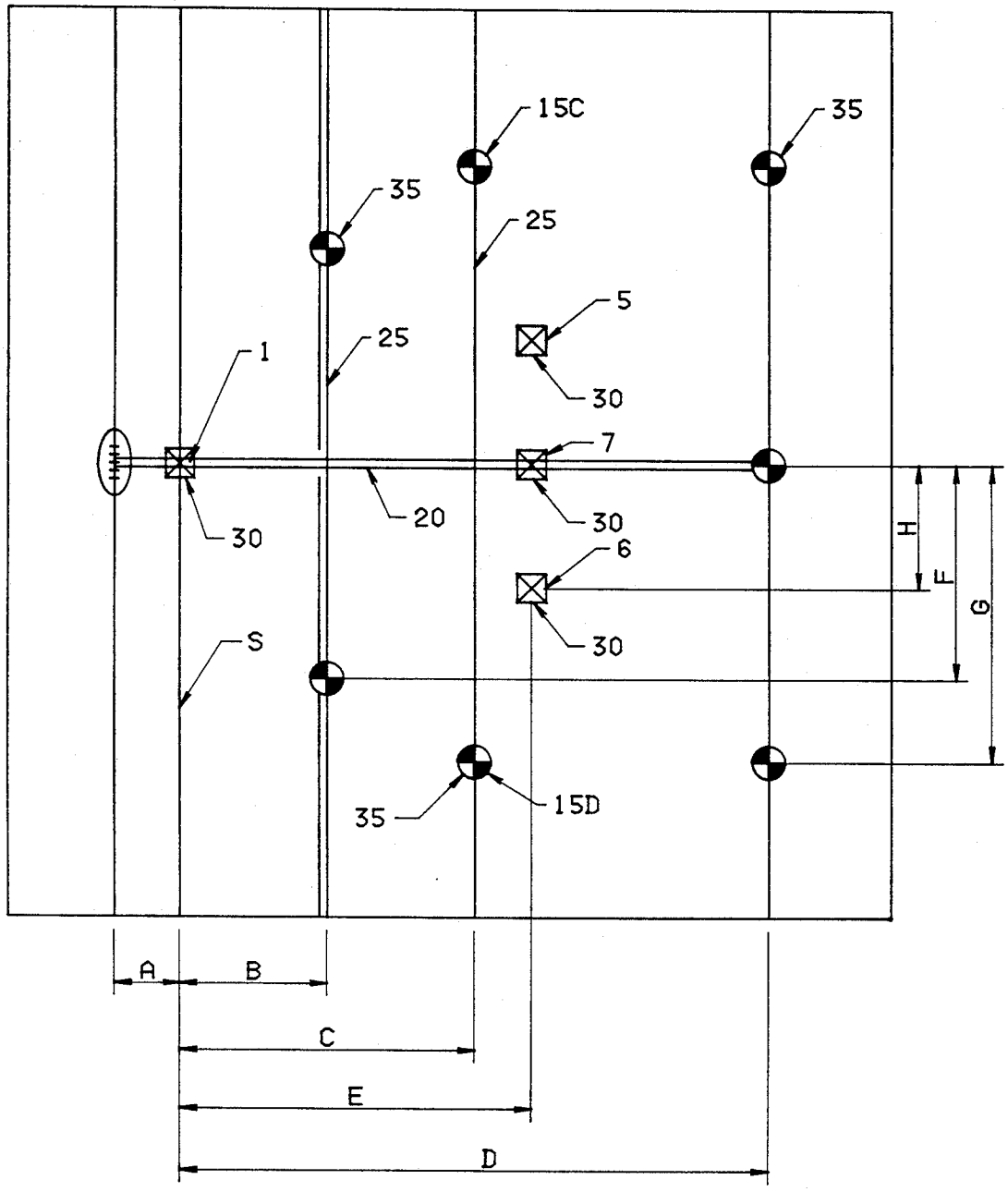
FIG. 2 is a plan view similar to FIG. 1 with the defensive player positions shown in a typical 1-3 defensive alignment.
Figure 3:
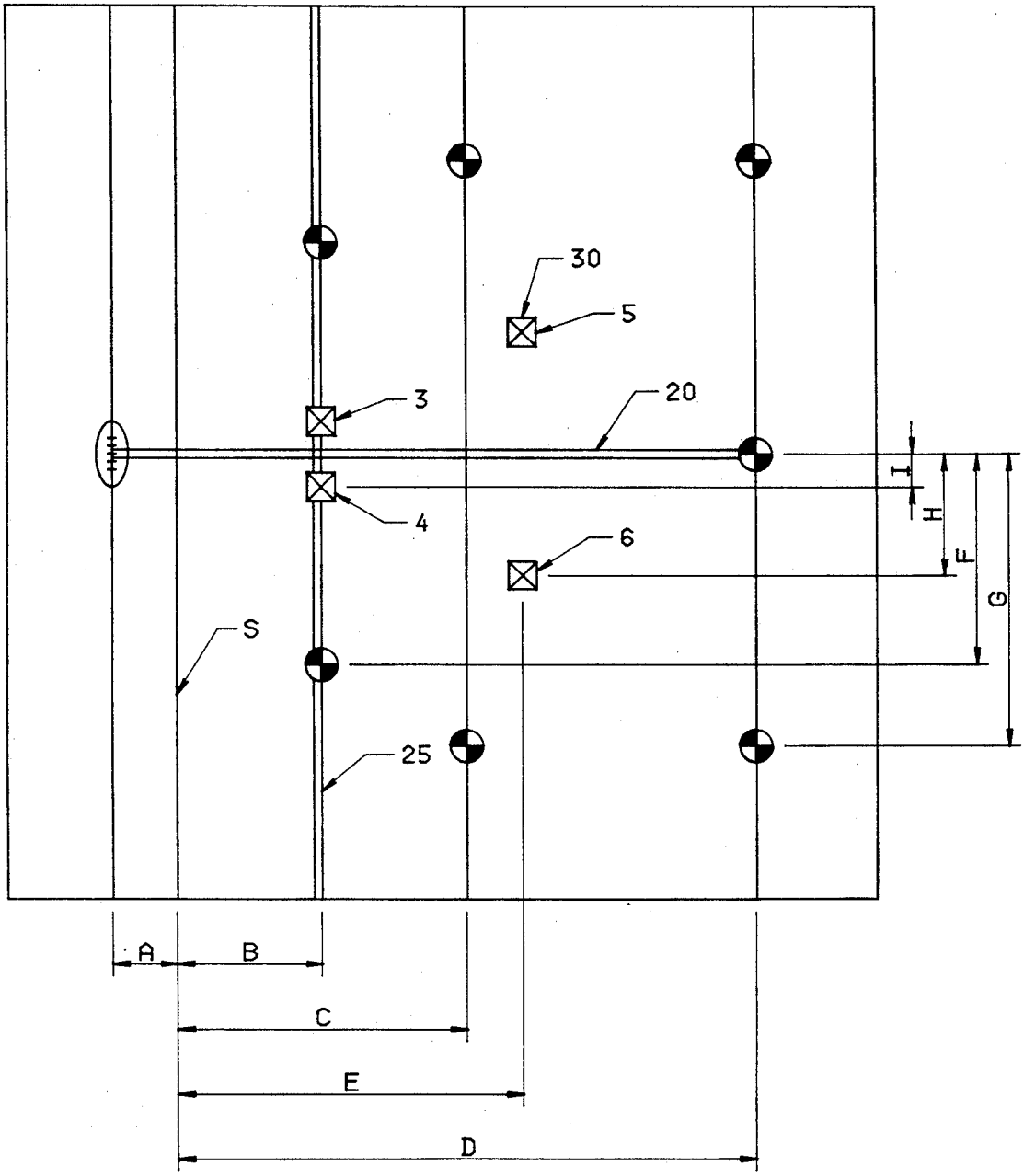
FIG. 3 is a plan view similar to FIG. 1 with the defensive player positions shown in a typical 2-2 defensive alignment.

Round flexible plastic discs or mats 35 may be used for the offensive player positions or nets at both the 5 and 10 yard intervals, the receivers being located in the indicated alignment as shown in FIGS. 1, 2 and 3. The second tape is then used to mark the two defensive player positions spaced from the center line about 7 yards or distance F therefrom as shown in FIG. 1 of the drawings. Two offensive player positions are marked at the 10 yard location from the line of scrimmage about 10 yards from the center line as shown in the drawings. The second tape is then moved to a position 20 yards from the line of scrimmage to mark the three receiver positions at the 20 yard interval from the line of scrimmage in a transverse linear alignment. One defensive position is marked on the center line at a distance of 12 yards from the line of scrimmage with the two outer defensive positions, each being about 10 yards from the center line.

Markings on the tape permit the expeditious alignment of a total of seven defensive player positions and seven offensive player positions at the spaced apart intervals as shown in FIGS. 1, 2 and 3. Each of the two tapes have markings thereon which facilitate the locations of preferred offensive and defensive player positions and their alternative positions depending upon whether three, four or five players are employed to play the game. The net or offensive player positions are marked by individual thin flexible round plastic disks or mats as shown in the drawings and the defensive player positions are marked by individual thin flexible plastic square-shaped mats with an X thereon, and the prescribed code numbers for the 1-1-3, 2-2 or 1-3 defensive alignments. The defensive player markers may be color coded in one, two or three different color combinations, such as red, white and blue, to indicate the defensive alignment which may be called by the defense for a given play. Obviously, the alignments for playing the game may be measured by a standard flexible tape measure, or the equivalent thereof, using instructional sheets similar to the diagrams of FIGS. 1, 2 and 3. Such sheets and tapes are provided with a set of rules for playing the game.

Before the game is commenced, the required number of ball-receiving baskets or nets equal to the number of defensive players, is placed at selected locations on the playing field as indicated by the circles on FIG. 1. The defensive players assume various alignments as shown by the "X's" on FIGS. 1, 2 and 3. The quarterback takes the ball from a platform or small table (not shown) positioned about two yards behind the line of scrimmage and throws it as soon as possible, or when a net is unguarded, into one of the nets before one of the defenders can react to guard the net or nets which they are assigned for guarding. There will always be the same number of ball-receiving nets and defensive players. Thus, the game is equally balanced with the same number of nets as defenders. With the field marked as aforesaid, the play is conducted in one direction with the players keeping track of the downs and required yardage for a first down and scores, or an independent referee may be so used to monitor the play.

As shown in the drawings, on square or X No. 1 which is located adjacent the line of scrimmage "S" has markings of 1-3 and 1-1-2 for these defenses and is color-coded in two colors such as red and white. Square or X No. 2 is marked with the 1-1-2 defense and is color-coded with one color such as white. Squares or X Nos. 3 are located at 1 yard or distance I from the centerline, and 4 as shown in FIG. 3 are marked with the 2-2 defense and are colored with one color such as blue. Square or X Nos. 5 and 6 located at 4 yards or distance H from the centerline, marked with all three defenses, 1-3, 1-1-2 and 2-2, and color-coded with all three colors; red, white and blue. Square or X No. 7 as shown in FIG. 2 is marked with the 1-3 defense and color-coded with one color, red. Thus, the squares or Xs are all marked with a prescribed defensive scheme and a distinctive color for the defensive alignment selected for a given play.

A main feature of the invention is the concept or method of playing a football game, either indoors or outdoors, using stationary targets in the form of nets or baskets, with the same number of nets or receivers as the number of defenders for covering the same whereby the defensive players attempt to prevent the completion of a forward pass into a guarded or unguarded net by the quarterback. The only way for the nets to be unguarded is when the defense calls a so-called "blitz" to rush the quarterback. When one defensive layer rushes the quarterback, one net is left unguarded. When two players rush the quarterback, two nets are unguarded. And the quarterback attempts to pass into one such unguarded net before being downed.

Figure 5:
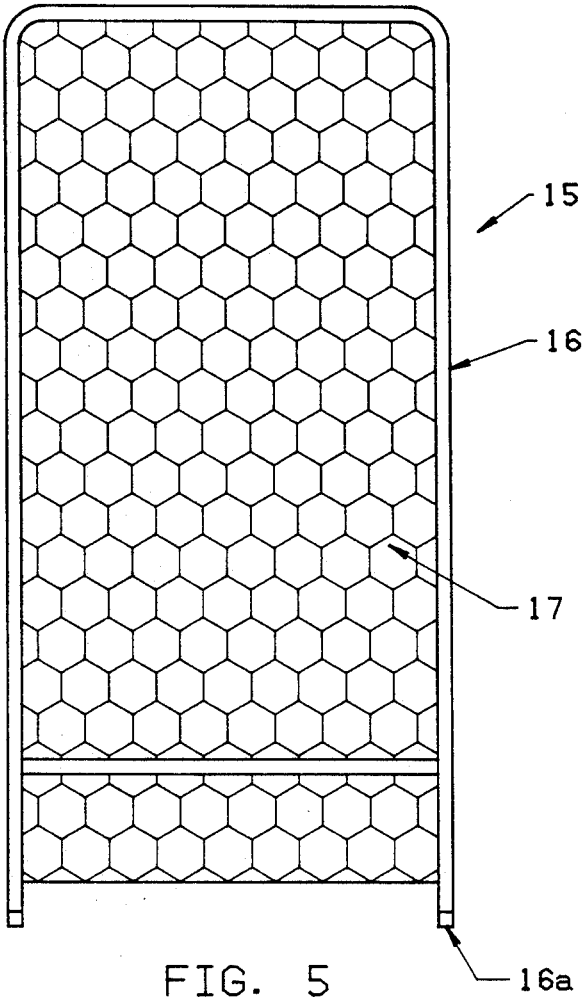
FIG. 5 is an enlarged front view of the ball receiving net shown in FIG. 4.
Figure 6:
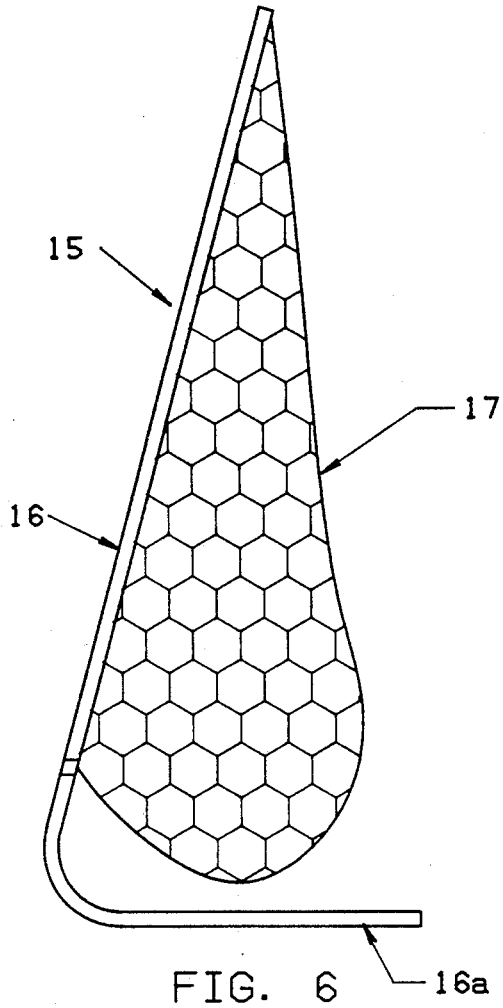
FIG. 6 is an enlarged side elevational view of the ball receiving net shown in FIGS. 4 and 5.
Figure 4:
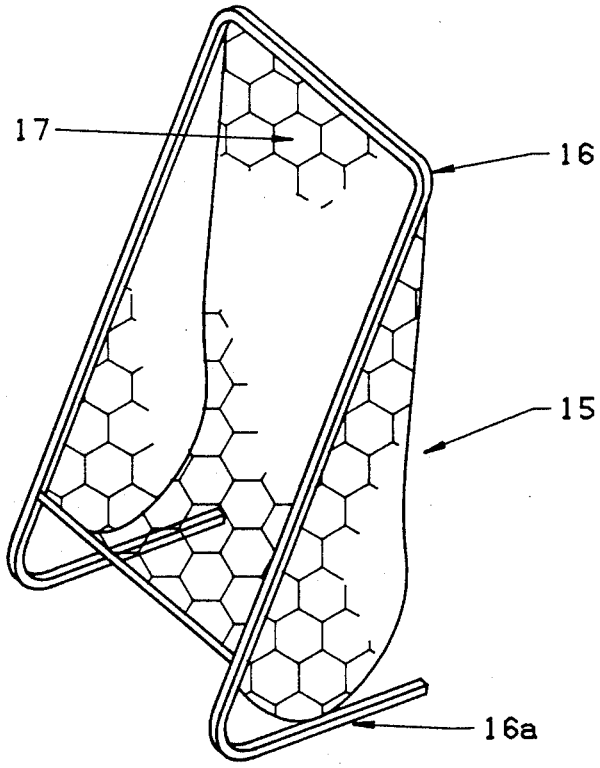
FIG. 4 is a perspective view of a typical ball receiving net.

The nets or baskets 15 preferably have an upright rectangular configuration with dimensions of about 3 by 6 feet approximating the average distances an actual receiver stretching in various directions can receive and catch the ball. The net is shown in perspective in FIG. 4 and in side elevational and front views in FIGS. 5 and 6. A rectangular light-weight tubular frame 16 is used to support a flexible mesh-like net 17 in an upright position generally similar to the practice net used by field goal kickers. The net 15 has a generally sloping L-shaped configuration with a footed portion 16*a* to permit its standing upright at the designated location.

The game is designed so that there will be one defender who has to cover more ground to defend his designated receiver or net 15. This receiver will always change depending upon how the quarterback establishes the locations of his receivers and what formation the defense assumes for a given play. The defense may or may not cover the same receivers from the same formation. The game requires the quarterback to quickly read the defensive alignment of the defensive players and try to find the open receiver. The defense may also rush the passer in the form of a blitz, by one or more defenders, leaving at least one receiver and possibly two receivers totally uncovered.

The game may be played on a level field with a plurality of disks or markings indicating the positions of the nets or receivers, the quarterback starting position, and the spaced defensive player positions for the start of play. The game is played with flexible thin mats in the form of circles for net positions and squares or Xs indicating the defensive player positions for the start of play. The basic field alignments normally have a configuration of a cross of Lorraine indicating the net and defensive player positions on the cross members in transverse alignment and some of the defensive positions on the center line of the cross. The defensive positions permit varying the defense from 1-1-2, 2-2 to 1-3 alignments as elected by and called for by the defense to defend against a given offensive play.

A down and distance marker may be optionally used to designate the upcoming play situation for the offensive quarterback. Such marker is normally placed along one sideline to keep track of the pace of the game, and may also be used to indicate the score.

Initiation of Play

The total number of players must choose an order of rotation for the quarterback position for the entire game, which rotation does not change. One player assumes the quarterback position as the offense and all other players are on defense as defensive players. The quarterback will use the same number of receivers as there are defenders. The total number of players elect the method for sacking the quarterback such as by touching or throwing a flag. The total number of players choose the length of the game depending on the number of positions of each player during the course of the game.

Quarterback Position

The first quarterback will initiate the game from his own 30 yard line and the same 30 yard line will also be the starting point after every score. Each quarterback establishes the positions of his receivers (nets) at his option before starting each possession of the ball. The quarterback must set at least one net at each distance of 5, 10 and 20 yards if there are the preferred number of four or five players. The quarterback may change the location of the nets once during each possession except at opponent's 5 yard line (see Scoring). The quarterback may change the net locations when reaching the opponents 5 yard line even though he has previously made one change during that possession. The reason being, a 20 yard pass from the 5 yard line would be out of the end zone in the traditional game. Thus, the nets or targets are moved to 5 and 10 yard locations from the line of scrimmage thus moving the defense into a tighter formation such as the 2-2 defense, and making scoring more difficult, as in the traditional game.

The quarterback is allowed three passes to gain ten yards and a first down. The primary reason for three plays is a team in the traditional game would normally be required to punt the football if five or more yards were needed for a first down. The quarterback is permitted four downs when inside the opponents 30 yard line or if it is a last possession of a game. The quarterback retains possession of the ball as long as he continues to make first downs.

In the event the quarterback fails to make a first down, the quarterback following him in the rotation will take the ball at the line of scrimmage where the prior quarterback failed and proceed in the opposite direction. As an example, to start the game, the first quarterback takes the ball as his own 30 yard line needing 70 yards for score. If he fails to complete a pass in his first three throws, quarterback No. 2 takes over on the opponents 30 yard line and needs only 30 yards for a score.

A sack of the quarterback, such as by touching, is a loss of five yards. The quarterback may not run the ball past the line of scrimmage but may avoid defenders in the backfield by running to avoid a sack if there is a blitz. The quarterback must start play with both feet in the center position behind the platform or table and move both feet from such designated starting position before throwing a pass. The play starts when the quarterback takes the ball from the platform or table representing the manner in which the quarterback takes the ball from the center in the traditional game.

Defense

The defensive players must line up on defensive markers indicated by the "X's" in FIGS. 1, 2 and 3. The defensive players must line up in either of 1-1-2, 1-3 or the 2-2 defensive formation. The defense cannot move until the ball is moved off the platform by the quarterback. If a defender jumps over the line in the 1-1-2 or 1-3 defensive alignments, it is offside defense and the offense receives a five yard penalty. If on the opponent's five yard line, an offside penalty would result in an automatic first down. If an offside penalty occurs on first down, it is disregarded.

The quarterback may not purposely try to draw the defense offside by making a sudden move with his body but not moving the ball, such as in the traditional game. The quarterback may attempt to draw an offside penalty with his voice in calling a starting signal. The defense cannot hurdle the center and must go around the center platform or table to tag the quarterback. If attempting to call a defensive blitzing formation, the defense cannot touch or move the receiver (net) before the ball arrives. If such an infraction occurs, it is considered a completed pass if the ball was thrown to the receiver (net) that was hit or moved. The defensive players may blitz at any time. There is no rotation of the defensive players. The defense tries to position its players within a certain formation so that it will be the strongest alignment to defend the receivers.

Interceptions

An interception is a ball that the defense catches before it touches the ground as in the traditional game and balls bouncing off the receivers can be intercepted if the ball does not touch the ground. In the event a quarterback throws an interception, his offensive possession is completed and the next quarterback in the rotation takes possession, not necessarily the defender making the interception. If the pass is intercepted, the yardage of the intended pass is added to the line of scrimmage and the next quarterback in the rotation will start possession at that point theoretically going in the opposite direction. However, the game is played continually advancing the ball in one direction as the field is marked. As an example, if the quarterback is on his own 20 yard line needing 80 yards to score and a pass is thrown to the receiver at 20 yards and is intercepted, the 20 yard pass is added to the line of scrimmage being the 20 yard line so the next quarterback would take over on his opponent's 40 yard line needing 40 yards for a score. A pass intercepted in the end zone comes out to the 30 yard line to continue play.

Scoring

A quarterback receives six points for a touchdown. The quarterback attempts to score the extra point after a touchdown, he may move the receivers (nets) again even if they have been moved once already during the possession. The quarterback starts at the five yard line and gets one play to score. The extra point is worth one point. No 20 yard pass can be thrown since the ball is on the five yard line and the net should be moved up to the five and ten yard ranges from the line of scrimmage.

Where the game is played by opposing sides consisting of one quarterback and four defensive players, the four defensive players attempt to guard for defensive receivers (nets). Three basic defensive formations may be employed as described above, normally, a 1-1-2, 1-3, or 2-2 defense. In the event there are four players, including one quarterback and three defenders, there would normally be three defenders and three receivers which may assume any of the three basic defenses with one defender at the receiver positions of 5, 10 and 20 yards are set. These distances which are based upon the timing aspects of the traditional game of about 1.5 seconds for each defender to cover each of the receivers and to force the quarterback to hurry his throw with possible blitzing defenses. One of the basic features of the game is requiring the quarterback to react quickly to determine the open receiver and for the defense to react quickly to oppose the completion of a pass into an unguarded receiver i.e., a net.

The quarterback may run the width of the field and retain possession to evade blitzing defenders. The greater the distance of the receiver positions from the line of scrimmage, the greater the distance the defenders must be located initially to cover the longer spaced receivers. The defensive players can rotate their defensive alignment to cover the receivers and to confuse the quarterback. The defensive patterns can cover the receivers and prevent a completed pass to one of such receivers by deflecting or intercepting the pass.

The game is simulated wherein the five yard receivers are an imitation of a back coming out of the backfield in the traditional game for the five yard receptions. The down and out patterns are established at the ten yard intervals and the deep patterns are imitated at the 20 yard positions. The game may be played in a much more confined space than a normal football field, or even one-half of such field.

The defensive positions may be color coded having basically one or more of three colors indicating the type of defense which has been called by the defensive team for a given play. The defensive positions may be shown on the upper side of the square mats and the offensive positions are shown by the circular mats.

The subject game is particularly valuable for teaching younger children the basic requirements of the traditional passing game and assists in developing their athletic skills for passing and defending for subsequently playing the traditional game.

Accordingly, the subject new football game is simplified, provides an effective, safe, inexpensive, and efficient apparatus and method of playing, which achieves all the enumerated objectives, provides for eliminating difficulties encountered with prior art methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved game and apparatus is constructed and used, the characteristics of the construction, and the advantageous, new and useful results obtained; the new and useful structures, devices, elements, arrangements, parts and combinations, are set forth in the appended claims.

I claim:

1. Combined apparatus for playing a football passing game to be played by 3 to 5 players including one quarterback offensive player and the remainder defensive players comprising a) a field area of substantially rectangular configuration having dimensions of at least about 30 by 40 yards, b) a football, c) an upright platform positioned behind the line of scrimmage from which the quarterback player obtains the football to initiate a given play, d) a plurality of movable upright football-receiving net members equal to the number of defensive players to be positioned downfield at five, ten or twenty yard intervals from the line of scrimmage at the option of the quarterback player, and e) a plurality of markings of fixed defensive player positions marked on said field at prescribed spaced distances from said net members for initial positioning of the said defensive players upon initiation of a given play to prevent the quarterback player from advancing said football by successfully passing said football into one of said net members.

2. Combined apparatus in accordance with claim 1, wherein a) the said plurality of markings of defensive player positions marked on said field are greater in distance from said net members the greater the distance of said net members from the line of scrimmage.

3. Combined apparatus in accordance with claim 1, wherein a) the said net members are positioned by said quarterback offensive player at spaced-apart fixed positions once for each possession selected from 7 different locations all beyond the defensive player positions marked on said field.

4. Combined apparatus in accordance with claim 1, wherein a) the said movable football-receiving net members are positioned within five and ten yard intervals from the line of scrimmage when the said quarterback player has advanced the football to within 5 yards of the goal line.

5. Combined apparatus in accordance with claim 1, wherein a) the said markings for said defensive players are arranged at 7 different locations on said field within the periphery of said net members to prevent the quarterback player from advancing the ball by successfully passing the football into one of said net members.

6. Combined apparatus in accordance with claim 1, including a) a first flexible tape member having a length of about 22 yards marking said field transversely at about 5, 10 and 20 yard intervals from the line of scrimmage for mounting said net members spaced from said center line at about 7 different locations, and a second flexible tape member for initial positioning of said defensive players located at prescribed spaced-apart positions interiorly of said net members.

7. A football passing game to be played by 3 to 5 players including one quarterback offensive player and the , remainder defensive players comprising a) a playing field area of substantially rectangular configuration having dimensions of at least about 30 by 40 yards, b) a football, c) an upright platform positioned behind the line of scrimmage from which the quarterback player obtains the football to initiate a given play, d) a plurality of movable upright football-receiving net members equal to the number of defensive players to be positioned downfield at five, ten or twenty yard intervals from the line of scrimmage at the option of the quarterback player, and e) a plurality of fixed defensive player positions marked on said field at prescribed spaced distances from said net members for initial positioning of the said defensive players upon initiation of a given play to prevent the quarterback player from advancing said football by successfully passing said football into one of said net members.

8. A football passing game in accordance with claim 7, wherein a) the said defensive player positions marked on said field are greater in distance from said net members the greater the distance of said net members from the line of scrimmage.

9. A football passing game in accordance with claim 7, wherein a) the said net members are positioned by said quarterback offensive player at spaced-apart fixed positions once for each possession selected from 7 different locations all beyond the defensive player positions marked on said field.

10. A football passing game in accordance with claim 7, wherein a) the said quarterback offensive player must advance the football for at least 10 yards within 3 consecutive downs, unless the ball resides within the opponent's 30 yard line, by successfully throwing the football into one of said net members in order to retain ball possession to advance the ball toward the goal line.

11. A football passing game in accordance with claim 7, wherein a) in the event that said quarterback offensive player does not advance the football the required 10 yards within three consecutive downs, one of the defensive players becomes the quarterback offensive player and the former quarterback player becomes a defensive player in an agreed-upon rotation.

12. A football passing game in accordance with claim 7, wherein a) the said quarterback offensive player must advance the football for at least 10 yards within 4 downs when the football resides within the opponent's 30 yard line by successfully throwing the football into one of said net members.

13. A football passing game in accordance with claim 7, wherein a) the said movable football-receiving net members are positioned within five and ten yard intervals from the line of scrimmage when the said quarterback player has advanced the football to within 5 yards of the goal line.

14. A football passing game in accordance with claim 7, wherein a) the said quarterback offensive player cannot advance the football over the line of scrimmage by running, but may delay throwing the football until downed by one of the defensive players behind the line of scrimmage ending the given play.

15. A football passing game in accordance with claim 7, wherein a) in the event said quarterback player does not advance the football for 10 yards within 3 consecutive downs by successfully passing the football into one of said net members, the quarterback position is rotated for the next series of plays in a prescribed rotation among the said defensive players.

16. A football passing game in accordance with claim 7, wherein a) the said quarterback player can change the net member positions only once during each possession unless within the 5 yard line of opponent's goal line when the said net members can be positioned at 5 and 10 yard intervals.

17. A football passing game in accordance with claim 7, including a) a first flexible tape member having a length of about 22 yards and a second flexible tape member having a length of about 22 yards for mounting said net members spaced from said center line at about 7 different locations, said markings for initial positioning of said defensive players being located at prescribed spaced-apart positions interiorly of said net members.

18. A football passing game in accordance with claim 7, wherein a) the said defensive players may be arranged in varied defensive alignments at said defensive player positions marked at 7 different locations on said field within the periphery of said net members to prevent the quarterback player from advancing the ball by successfully passing the football into one of said net members.

19. A football passing game in accordance with claim 7, wherein a) the said defensive players cannot move from their marked defensive positions until the football is initially moved by said quarterback offensive player.

20. A football passing game in accordance with claim 7, wherein a) successfully passing over the goal line is worth 6 points for a touchdown and the extra point worth 1 point is allowed by one passing play from the 5 yard line.

21. The method of playing a football passing game to be played by 3 to 5 players including one quarterback player and the remainder defensive players comprising the steps of a) providing a football, b) marking a playing field area of substantially rectangular configuration having dimensions of at least about 30 by 40 yards, c) positioning an upright platform behind the line of scrimmage from which the quarterback player obtains the football to initiate a given play, d) positioning a plurality of movable upright football-receiving net members equal to the number of defensive players at five, ten or twenty yard intervals from the line of scrimmage at the option of the quarterback player, and e) marking a plurality of fixed defensive player positions on said field area at predetermined spaced-apart locations interiorly of said net members for initial positioning of said defensive players at spaced-apart distances from and within the periphery of said net members to prevent the quarterback player from advancing said football by successfully passing said football into one of said net members.

22. The method of playing a football passing game in accordance with claim 21, including the step of a) marking the said defensive player positions on said field area greater in distance from said net members the greater the distance of said net members from the line of scrimmage.

23. The method of playing a football passing game in accordance with claim 21, wherein a) the said quarterback offensive player cannot advance the football over the line of scrimmage by running, but may delay throwing the football until downed by one of the defensive players behind the line of scrimmage ending the given play.

24. The method of playing a football passing game in accordance with claim 21, wherein a) the said quarterback offensive player must advance the football for at least 10 yards within three consecutive downs, unless the ball resides within the opponent's 30 yard line, by successfully throwing the football into one of said net members in order to retain ball possession to advance the ball toward the goal line.

25. The method of playing a football passing game in accordance with claim 21, wherein a) in the event that said quarterback offensive player does not advance the football the required 10 yards within three consecutive downs, unless the ball resides within the opponent's 30 yard line, one of the defensive players becomes the quarterback offensive player and the former quarterback player becomes a defensive player in an agreed-upon rotation.

26. The method of playing a football passing game in accordance with claim 21, wherein a) the said movable football-receiving net members are positioned at five and ten yard intervals from the line of scrimmage when the said quarterback player has advanced the football to within 5 yards of the goal line.

27. The method of playing a football passing game in accordance with claim 21, wherein a) in the event the quarterback player does not advance the football for 10 yards within 3 consecutive downs, unless the ball resides within the opponent's 30 yard line, by successfully passing the football into one of said net members, the quarterback position is rotated for the next series of plays in a prescribed rotation among the defensive players.

28. The method of playing a football passing game in accordance with claim 21, wherein, a) the said defensive player positions marked on said field are greater in distance from said net members the greater the distance of said net members from the line of scrimmage.

29. The method of playing a football passing game in accordance with claim 21, wherein a) the said plurality of markings for initial positioning of said defensive players is a number of about 7 which is greater than the number of defensive players to permit a variation of different defensive alignments.

30. The method of playing a football passing game in accordance with claim 21, wherein a) the said plurality of net member positions and said plurality of defensive player positions each total seven, the defensive player positions being located within the perimeter of said net members.

31. The method of playing a football passing game in accordance with claim 21, including a) a down and distance marker for indicating the particular down and distance required for a first down on any given play.

32. The method of playing a football passing game in accordance with claim 21, wherein a) the plurality of markings for said net members and plurality of markings for said defensive player initial positions are set forth on a flexible mat member having a configuration of a cross of Lorraine, the latter markings being set forth within the periphery of the former.

33. The method of playing a football passing game in accordance with claim 21, wherein a) the initial positioning of said defensive players may be aligned in a 2-2, 1-1-2, or 1-3 defensive alignments on said markings within said net members representing pass defensive strategies for a given play and situation.

34. The method of playing a football passing game in accordance with claim 21, wherein a) the said defensive alignments are represented by color-coded disc-type markings to be placed on the said field or mat member to indicate various defensive alignments, one different color for each alignment.

35. The method of playing a football passing game in accordance with claim 21, wherein a) at least 2 defensive player positions are fixed and the remainder are varied between 5 other positions to permit establishing varied defensive alignments.

* * * * *